US006939237B1

(12) United States Patent
Voden

(10) Patent No.: US 6,939,237 B1
(45) Date of Patent: Sep. 6, 2005

(54) POOL CUE HAVING ATTACHABLE WEIGHT

(76) Inventor: Justin L. Voden, S84 W19098 Enterprise Dr., Muskego, WI (US) 53150

( * ) Notice: Subject to any disclaimer, the term of this patent is extended or adjusted under 35 U.S.C. 154(b) by 0 days.

(21) Appl. No.: 10/426,277

(22) Filed: Apr. 30, 2003

(51) Int. Cl.[7] ..... A63D 15/08
(52) U.S. Cl. ..... 473/44
(58) Field of Search ..... 473/44–49

(56) References Cited

U.S. PATENT DOCUMENTS

| | | | | | |
|---|---|---|---|---|---|
| 298,111 | A | * | 5/1884 | Morse | 473/46 |
| 507,471 | A | * | 10/1893 | Barger | 473/36 |
| 608,457 | A | * | 8/1898 | Hutzel | 473/47 |
| 829,749 | A | * | 8/1906 | Adorjan | 473/47 |
| 835,489 | A | * | 11/1906 | Adorjan | 473/47 |
| 935,218 | A | * | 9/1909 | Moore | 473/47 |
| 1,026,990 | A | * | 5/1912 | Matson | 473/519 |
| 3,342,489 | A | * | 9/1967 | Waldo | 473/47 |
| 3,372,932 | A | * | 3/1968 | Molis | 473/47 |
| 5,112,046 | A | * | 5/1992 | Thorpe | 473/47 |
| 5,326,329 | A | | 7/1994 | Doss | 473/47 |
| 6,113,501 | A | | 9/2000 | Richards | 473/46 |
| 6,712,712 | B2 | * | 3/2004 | Bourque | 473/46 |
| 2002/0022529 | A1 | * | 2/2002 | Bourque | 473/46 |
| 2002/0072423 | A1 | | 6/2002 | Pot | 473/44 |
| 2002/0128085 | A1 | * | 9/2002 | Kallassy | 473/256 |

FOREIGN PATENT DOCUMENTS

| | | | |
|---|---|---|---|
| FR | 1010735 | * | 6/1952 |
| GB | 10476 | * | 5/1896 |
| GB | 2209681 | * | 5/1989 |

* cited by examiner

*Primary Examiner*—Mark S. Graham
(74) *Attorney, Agent, or Firm*—Ziolkowski Patent Solutions Group, SC

(57) ABSTRACT

A pool cue having attachable weight includes a pool cue, at least one weight, and a weight retainer. A threaded hole is formed in a butt end of the pool cue. A weight retainer preferably includes a bumper cap and a threaded rod. The threaded rod extends from one end of the bumper cap. The threaded hole is sized to threadably receive the threaded rod. A hole or a slotted opening is formed through the weight to receive the threaded rod. A location projection is preferably formed on one end of the weight and a location cavity is preferably formed on the other end of the weight. The location cavity is sized to receive the location projection. The location projection and cavity ensure that a plurality of weights will be concentric to each other.

25 Claims, 3 Drawing Sheets

POOL CUE HAVING ATTACHABLE WEIGHT

BACKGROUND OF THE INVENTION

1. Field of the Invention

The present invention relates generally to pool cues and more specifically to a pool cue having attachable weight, which allows the weight of the pool cue to be modified for different types of pool shots.

2. Discussion of the Prior Art

There are several patents, which disclose placing added weight on or near the end of a pool cue. Added weight to an end of a pool cue improves the inertia of the pool cue during certain shots, such as a break shot. U.S. Pat. No. 5,326,329 to Doss discloses a jump-shoot pool cue. The Doss patent includes a weight carrier which is capable of being loaded with weights. U.S. Pat. No. 6,113,501 to Richards discloses a billiard cue stick accessory. The Richards patent includes a tubular member, which is slid on to the pool cue. Patent application no. U.S. 2002/0072423 by Pot discloses a billiard cue stick. A slot is formed in an end of the handle that sized to receive spherical weights. However, none of these patents disclose adding weight to a butt end of a pool cue.

Accordingly, there is a clearly felt need in the art for a pool cue having attachable weight, which allows weight to be added to a butt end of a pool cue.

SUMMARY OF THE INVENTION

The present invention provides a pool cue having attachable weight for different types of billiard shots. The pool cue having attachable weight (weighted pool cue) includes a pool cue, at least one weight, and a weight retainer. A threaded hole is formed in a butt end of the pool cue. The weight retainer preferably includes a bumper cap and a threaded rod. The threaded rod extends substantially perpendicular from one end of the bumper cap. The threaded hole is sized to threadably receive the threaded rod. A hole or a slotted opening (slot) is formed through the weight to receive the threaded rod. A location projection is preferably formed on one end of the weight and a location cavity is preferably formed on the other end of the weight. The location cavity is sized to receive the location projection. The location projection and cavity ensure that a plurality of weights will be concentric to be each other. A flat may be formed on the location projection and in the location cavity of a weight that includes a slot. The flat would ensure that the plurality of weights would not rotate relative to each other.

Accordingly, it is an object of the present invention to provide a weighted pool cue, which allows weight to be added to a butt end of a pool cue.

These and additional objects, advantages, features and benefits of the present invention will become apparent from the following specification.

DETAILED DESCRIPTION OF THE PREFERRED EMBODIMENTS

Figure 1:
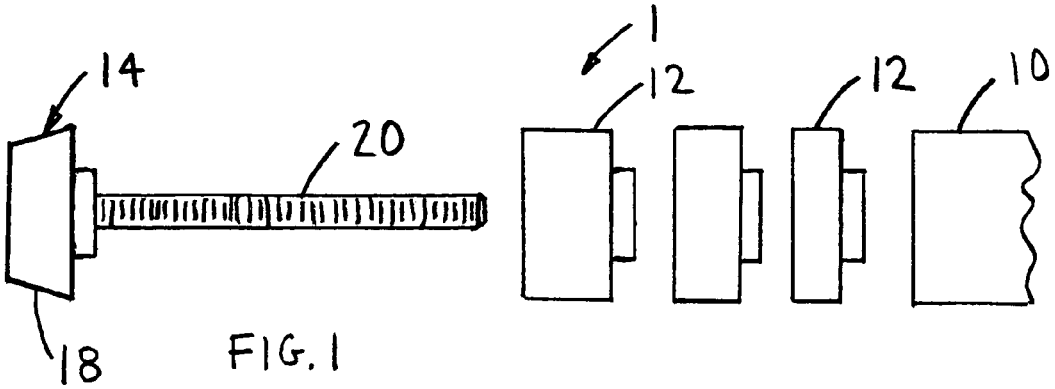
FIG. 1 is an exploded side view of a weighted pool cue in accordance with the present invention.
Figure 2:
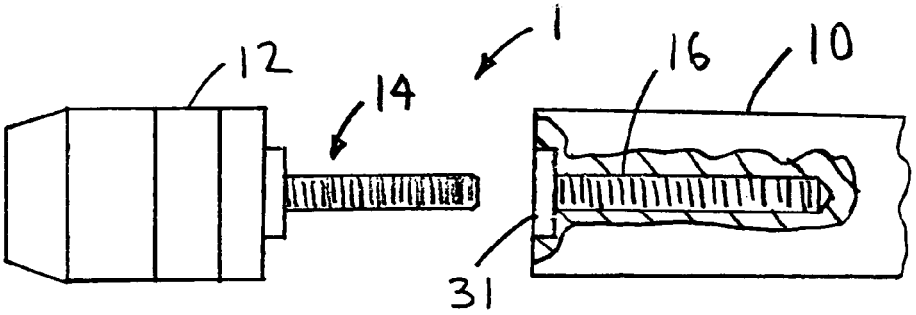
FIG. 2 is a side view of a plurality of weights retained on a weight retainer adjacent a butt end of a pool cue of a weighted pool cue in accordance with the present invention.
Figure 3:
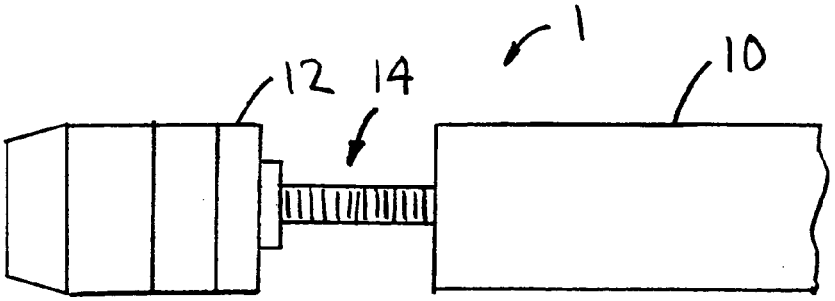
FIG. 3 is a side view of a plurality of weights retained on a weight retainer and the weight retainer partially threaded into a butt end of a pool cue of a weight pool cue in accordance with the present invention.
Figure 4:
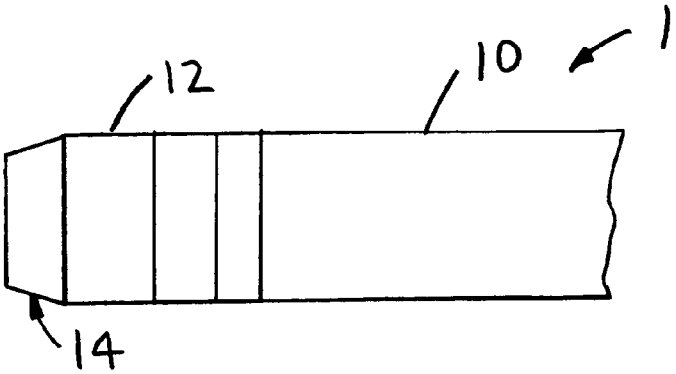
FIG. 4 is a side view of an end of a weighted pool cue in accordance with the present invention.
Figure 5A:
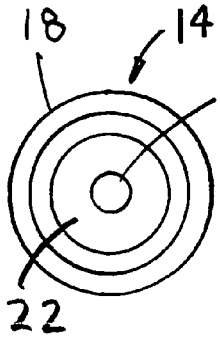
FIG. 5*a* is an end view of the other end of a weight retainer of a pool cue in accordance with the present invention.
Figure 5B:
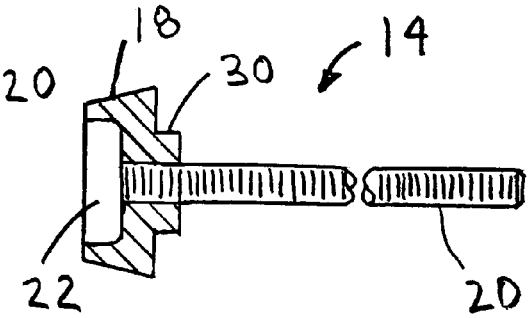
FIG. 5*b* is a side cross sectional view of a weight retainer of a pool cue in accordance with the present invention.
Figure 5C:
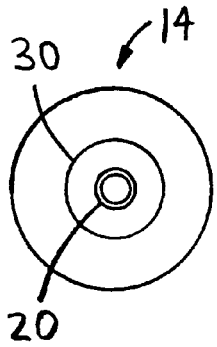
FIG. 5*c* is an end view of one end of a weight retainer of a pool cue in accordance with the present invention.

With reference now to the drawings, and particularly to FIG. 1, there is shown an exploded side view of a weighted pool cue 1. With reference to FIGS. 2–4, the weighted pool cue 1 includes a pool cue 10, at least one weight 12, and a weight retainer 14. A threaded hole 16 is formed in a butt end of the pool cue 10. With reference to FIGS. 5*a*–5*c*, the weight retainer 14 preferably includes a bumper cap 18 and a threaded rod 20. The threaded rod 20 extends substantially perpendicular from one end of the bumper cap 18. The bumper cap 18 is preferably fabricated from a resilient material and preferably resembles a bumper cap 18 on the butt end of a normal pool cue. A cavity 22 is preferably formed in the other end of the bumper cap 18. The threaded rod 20 is preferably retained in the bumper cap 18 with a force fit, adhesive or any other appropriate attachment method. The threaded hole 16 is sized to threadably receive the threaded rod 20 and deep enough to fully receive a length of the threaded rod 12 without any weights 12 thereupon.

Figure 6A:
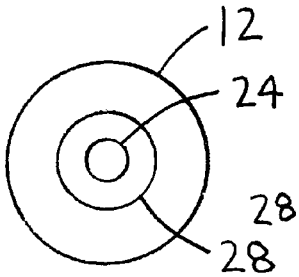
FIG. 6*a* is an end view of the other end of a weight with a hole formed therethrough of a weighted pool cue in accordance with the present invention.
Figure 6B:
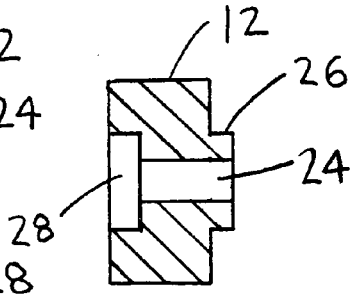
FIG. 6*b* is a side cross sectional view of a weight with a hole formed therethrough of a weighted pool cue in accordance with the present invention.
Figure 6C:
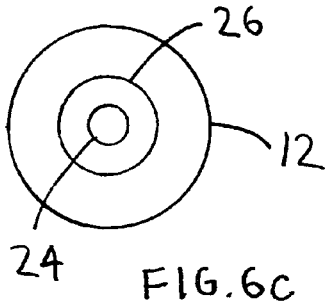
FIG. 6*c* is an end view of one end of a weight with a hole formed therethrough of a weighted pool cue in accordance with the present invention.

With reference to FIGS. 6*a*–6*c*, a hole 24 is formed through each weight 12 to receive the threaded rod 20. A location projection 26 is preferably formed on one end of the weight 12 and a location cavity 28 is preferably formed on the other end of the weight 12. The location cavity 28 is sized to receive the location projection 26. The location projection and cavity ensure that a plurality of weights 12 will be concentric to be each other. A bumper location projection 30 extends from the one end of the bumper cap 18. The bumper location projection 30 is sized to be received by the location cavity 28 of each weight 12. A cue location cavity 31 is formed in the butt end of the pool cue 10 concentric with the threaded hole 16.

Figure 7A:
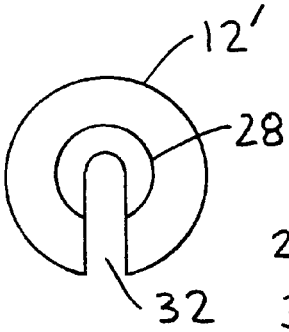
FIG. 7*a* is an end view of the other end of a weight with a slot formed therethrough of a weighted pool cue in accordance with the present invention.
Figure 7B:
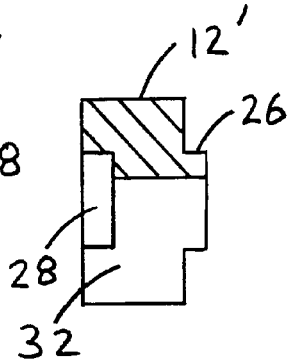
FIG. 7*b* is a side cross sectional view of a weight with a slot formed therethrough of a weighted pool cue in accordance with the present invention.
Figure 7C:
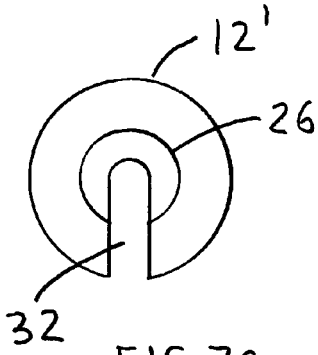
FIG. 7*c* is an end view of one end of a weight with a slot formed therethrough of a weighted pool cue in accordance with the present invention.

With reference to FIGS. 7*a*–7*c*, a slot 32 is formed through a second embodiment of each weight 12' to receive the threaded rod 20. The slot 32 allows weights to be removed from the threaded rod 20 without having to completely unscrew the threaded rod 20 from the pool cue 10. The location projection 26 is preferably formed on one end of the weight 12' and the location cavity 28 is preferably formed on the other end of the weight 12'. The location cavity 28 is sized to receive the location projection 26. The bumper location projection 30 is sized to be received by the location cavity 28 of each weight 12'.

Figure 8A:
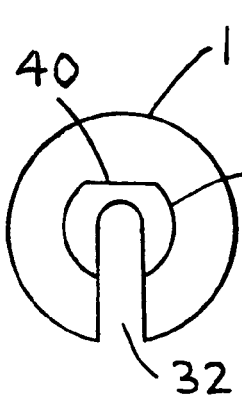
FIG. 8*a* is an end view of the other end of a weight with a slot formed therethrough and a flat formed on a location projection and cavity of a weighted pool cue in accordance with the present invention.
Figure 8B:
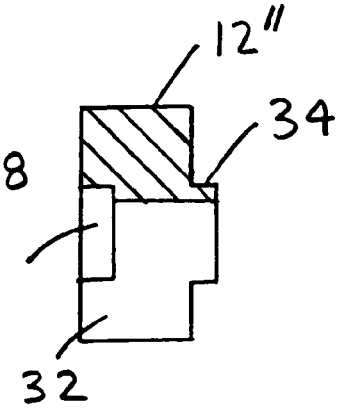
FIG. 8*b* is a side cross sectional view of a weight with a slot formed therethrough and a flat formed on a location projection and cavity of a weighted pool cue in accordance with the present invention.
Figure 8C:
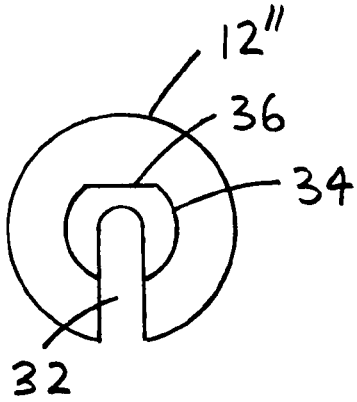
FIG. 8*c* is an end view of one end of a weight with a slot formed therethrough and a flat formed on a location projection and cavity of a weighted pool cue in accordance with the present invention.

With reference to FIGS. 8*a*–8*c*, a slot 32 is formed through a third embodiment of each weight 12" to receive the threaded rod 20. A location projection 34 is formed on one end of the weight 12". The location projection 34 includes a flat 36 that forces the slots 32 of each weight 12" to be aligned. A location cavity 38 is formed on the other end of the weight 12". The location cavity 38 includes a flat 40. The location cavity 38 is sized to receive the location projection 34. A flat is also formed on the bumper location projection 30 to be received by the location cavity 38 of each weight 12". It is preferable to offer a set of weights 12, 12', 12" that have different masses, such as 2 ounces, 4 ounces, 6 ounces and 8 ounces. However, other combinations of weights 12, 12', 12" may also be used. The hole 24, the slot 32 and any other shape of opening may also be described by the word "opening."

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A pool cue assembly comprising:

a pool cue terminating with a recess and a threaded channel extending inwardly from the recess, the threaded channel having a diameter less than that of the recess;

a retainer having a threaded rod terminating with a shoulder, the shoulder having a bumper thereon; and a first weight having a recess on one end to engage the shoulder of the retainer, and a protrusion on another end to engage the recess of the pool cue.

2. The pool cue assembly of claim 1 further comprising another weight having a recess on one end to engage the protrusion of the first weight and a protrusion on another end to engage the recess of the pool cue.

3. The pool cue assembly of claim 2 wherein the first weight and the another weight have substantially similar diameters and different lengths.

4. The pool cue assembly of claim 1 wherein the first weight has a slot constructed to allow the threaded rod to pass therethrough.

5. The pool cue assembly of claim 1 wherein the threaded rod of the retainer threadingly engages the threaded channel of the pool cue.

6. The pool cue assembly of claim 1 wherein the first weight has a diameter that is substantially similar to a diameter of the pool cue.

7. The pool cue assembly of claim 1 wherein the shoulder of the retainer is constructed to engage the recess of the pool cue.

8. The pool cue assembly of claim 1 wherein the recess of the pool cue further comprises a hub extending into the recess and the protrusion of the first weight further comprises an indexing land, the hub and the indexing land constructed to rotationally orient the first weight to the pool cue when connected thereto.

9. The pool cue assembly of claim 1 wherein the first weight is constructed of a material different than that of the pool cue.

10. A weight kit for a pool cue comprising:

a first weight having a length;

a second weight having a length different than the length of the first weight, and a retainer having a shaft portion and a cap portion, the shaft portion constructed to pass through the first weight and the second weight and removeably engage a pool cue to secure at least one of the first and second weights to a terminal end of the pool cue thereby extending a length of the pool cue by a length of the weight attached thereto wherein each weight has a diameter that is larger than a length of the weight.

11. The weight kit of claim 10 further comprising a third weight having a length different than the length of at least one of the first weight and the second weight.

12. The weight kit of claim 10 wherein at least one of the first weight and the second weight has an outer diameter generally similar to an outer diameter of a pool cue.

13. The weight kit of claim 10 wherein the retainer further comprises a shoulder extending therefrom, the shoulder constructed to engage a recess formed in each of the weights.

14. The weight kit of claim 10 wherein each of the first weight and the second weight have a location projection extending therefrom, each location projection interchangeably engageable with a location cavity formed in a butt end of a pool cue.

15. The weight kit of claim 10 wherein each location projection further comprises a flat portion extending tangentially across the location projection and constructed to radially position at least one of the first weight and the second weight relative to at least one of the retainer and the pool cue.

16. The weight kit of claim 10 wherein at least one of the first weight and the second weight further comprises a slot extending therethrough, the slot constructed to allow the weight to slide radially onto the shaft portion of the retainer.

17. The weight kit of claim 10 wherein at least one of the first weight and the second weight are constructed of a material different than a material of the pool cue.

18. A method of adjusting the mass of a pool cue comprising the steps of:

(a) positioning a desired mass on a shaft of a retainer, the desired mass having a length and a diameter, the diameter of the desired mass being substantially similar to a diameter of a pool cue and the length being less than the diameter; and (b) engaging the retainer with a recess formed in a terminal end of a pool cue with the desired mass positioned at a terminal end of the pool cue thereby increasing a length of the pool cue by a length of the desired mass and engaging a shoulder formed on the desired mass with an opening formed in the terminal end of the pool cue about the recess.

19. The method of claim 18 wherein the step of engaging the retainer further comprises meshing a plurality of threads formed on the retainer with a plurality of threads formed about the recess formed in the terminal end of the pool cue.

20. The method of claim 18 wherein the step of positioning the desired mass further comprises positioning a mass of a material different than a material of the pool cue on the shaft of the retainer.

21. The method of claim 18 further comprising aligning a ledge formed on the shoulder of the desired mass with a ridge formed in the opening of the pool cue.

22. The method of claim 18 wherein the step of positioning a desired mass on a retainer further comprises passing the retainer radially through the desired mass.

23. The method of claim 18 wherein the step of positioning a desired mass on a retainer further comprises selecting a desired mass from a plurality of interchangeable masses.

24. A method of adjusting the mass of a pool cue comprising the steps of:

(a) positioning a desired mass on a shaft of a retainer by passing the retainer radially through the desired mass, the desired mass having a length and a diameter, the diameter of the desired mass being substantially similar to a diameter of a pool cue and the length being less than the diameter; and (b) engaging the retainer with a recess formed in a terminal end of a pool cue with the desired mass positioned at a terminal end of the pool cue thereby increasing a length of the pool cue by a length of the desired mass.

25. A method of adjusting the mass of a pool cue comprising the steps of:

(a) positioning a desired mass selected from a plurality of interchangeable masses on a shaft of a retainer, the desired mass having a length and a diameter, the diameter of the desired mass being substantially similar to a diameter of a pool cue and the length being less than the diameter; and (b) engaging the retainer with a recess formed in a terminal end of a pool cue with the desired mass positioned at a terminal end of the pool cue thereby increasing a length of the pool cue by a length of the desired mass.

* * * * *